US007913809B2

(12) United States Patent
Zelinski

(10) Patent No.: US 7,913,809 B2
(45) Date of Patent: Mar. 29, 2011

(54) FLAPPER CONFIGURATION FOR MARINE EXHAUST SYSTEM

(75) Inventor: Joseph R. Zelinski, Oshkosh, WI (US)

(73) Assignee: CompX International Inc., Greenville, SC (US)

( * ) Notice: Subject to any disclaimer, the term of this patent is extended or adjusted under 35 U.S.C. 154(b) by 0 days.

(21) Appl. No.: 12/502,622

(22) Filed: Jul. 14, 2009

(65) Prior Publication Data

US 2010/0012422 A1 Jan. 21, 2010

Related U.S. Application Data

(60) Provisional application No. 61/134,901, filed on Jul. 15, 2008.

(51) Int. Cl.
*F01N 13/12* (2010.01)

(52) U.S. Cl. ..... 181/235; 181/237; 181/254

(58) Field of Classification Search ..... 181/235, 181/237, 254
See application file for complete search history.

(56) References Cited

U.S. PATENT DOCUMENTS

| | | | | |
|---|---|---|---|---|
| 3,206,836 | A | 9/1965 | Schlussler | |
| 3,470,690 | A | 10/1969 | Thompson | |
| 4,714,443 | A * | 12/1987 | Chaplin et al. | 440/89 R |
| 4,779,704 | A * | 10/1988 | Akiyama | 181/235 |
| 5,148,675 | A | 9/1992 | Inman | |
| 5,591,058 | A * | 1/1997 | Schriever et al. | 440/89 R |
| 5,739,483 | A * | 4/1998 | Yashiro et al. | 181/254 |
| 6,035,633 | A | 3/2000 | Woods | |
| 6,038,855 | A | 3/2000 | Markström et al. | |
| 6,205,778 | B1 | 3/2001 | Akaba et al. | |
| 6,397,589 | B1 | 6/2002 | Beson et al. | |
| 6,487,854 | B2 | 12/2002 | Maus | |
| 6,609,590 | B2 | 8/2003 | Zelinski | |
| 6,722,126 | B2 | 4/2004 | Kawamizu | |
| 6,918,246 | B2 | 7/2005 | Fukumoto et al. | |
| 7,013,565 | B1 | 3/2006 | Zelinski | |
| 7,052,343 | B2 * | 5/2006 | Ozaki et al. | 440/89 R |
| 7,104,359 | B1 | 9/2006 | Zelinski | |
| 7,347,045 | B2 * | 3/2008 | Bozmoski et al. | 60/312 |
| 2007/0107981 | A1 * | 5/2007 | Sicotte | 181/237 |

* cited by examiner

*Primary Examiner* — Elvin G Enad
*Assistant Examiner* — Forrest M Phillips
(74) *Attorney, Agent, or Firm* — Dority & Manning, P.A.

(57) ABSTRACT

Disclosed are apparatus and methodology for reducing noise and wear in a flapper configured exhaust tip for a marine exhaust system. A flapper, normally located within an exhaust tip of a marine exhaust system, is relocated upstream of the point in the exhaust system where cooling water normally contacts the exhaust pipe. An exhaust tip is coupled to the upstream portion of the exhaust system by way of an elastomeric coupling device. The flapper is positioned such that a tip thereof contacts the elastomeric coupling rather than the metallic exhaust pipe. Such contact with an elastomeric coupling device reduces noise previously produced by flapper contact with the hot exhaust pipe occasioned by destruction and/or heat degeneration of elastomeric material generally associated with the flapper device.

11 Claims, 2 Drawing Sheets

FLAPPER CONFIGURATION FOR MARINE EXHAUST SYSTEM

PRIORITY CLAIM

This application claims the benefit of previously filed U.S. Provisional Patent Application entitled "FLAPPER CONFIGURATION FOR MARINE EXHAUST SYSTEM," assigned U.S. Ser. No. 61/134,901, filed Jul. 15, 2008, and which is incorporated herein by reference for all purposes.

FIELD OF THE INVENTION

The present subject matter relates to exhaust systems. More specifically, the present subject matter discloses methods and apparatus for reducing wear and noise generation in a marine exhaust system.

BACKGROUND OF THE INVENTION

Water cooled marine exhaust systems have been previously employed to generally good effect, but have nevertheless possessed certain operational deficiencies. Prior exhaust tips have included various flapper configurations that are typically positioned downstream of a point at which cooling water flow mixes with exhaust gasses. Under normal operation, such positioning of exhaust flappers works well, but issues often arise upon generation of excessive heat levels within the exhaust systems.

In particular, flappers in such systems are often provided with sealing elastomeric, i.e., rubber, material along the edges of the perimeter of the flapper. With continued presence of excessive heat, as for example, from prolonged absence or reduction of cooling fluid, such elastomeric seals may become damaged to the point that direct metal-to-metal contact between the flapper and internal surfaces of the exhaust tips may occur. Such metal-to-metal contact may easily result in significant damage to the flapper as well as the exhaust tip. Additionally, such metal-to-metal contact often results in excessive noise generation during certain operational phases of the marine engine.

In light of such deficiencies recognized herewith in the known exhaust tip flapper configurations, it would be desirable to provide a flapper configuration that avoids such heat damage, and provides possibilities for reduced noise generation.

Various patents are known concerning marine exhaust related subject matter, including for example Zelinski U.S. Pat. No. 7,104,359 entitled "Muffler having a baffle with angled plates;" Zelinski U.S. Pat. No. 7,013,565 entitled "Removable collector for liquid cooled exhaust;" Zelinski U.S. Pat. No. 6,609,590 entitled "Exhaust system having angled baffle;" and Beson et al. U.S. Pat. No. 6,397,589 entitled "Exhaust pipes and assemblies." The disclosures of all the patents cited herein are hereby incorporated by reference for all purposes.

While various configurations of marine exhaust flapper arrangements have been developed, no design has emerged that generally encompasses all of the desired characteristics as hereafter presented in accordance with the subject technology.

SUMMARY OF THE INVENTION

In view of the recognized features encountered in the prior art and addressed by the present subject matter, an improved methodology for providing both noise reduction and reduced flapper wear has been developed. It should be understood that the present subject matter equally encompasses both methodologies and corresponding apparatuses.

In an exemplary configuration, previously provided exhaust flappers haves been relocated to significantly reduce noise.

In one form, the present subject matter provides an exhaust flapper located in a water-cooled exhaust system generally upstream of previously designated locations.

In accordance with aspects of certain embodiments of the present subject matter, an exhaust flapper is located proximate a junction point between a metallic exhaust tip and an elastomeric coupling device.

In accordance with certain aspects of other embodiments of the present subject matter, methodologies have been developed to reduce noise by positioning a flapper such that a portion thereof will, with normal movement, contact a sound-deadening surface.

In accordance with aspects of still further embodiments of the present subject matter, a flapper is positioned to contact an elastomeric coupling component to reduce contact generated noise.

One exemplary embodiment of the present subject matter relates to a flapper configuration for a marine exhaust system of the type having cooling water in contact with an exhaust pipe, comprising an exhaust pipe portion located upstream relative to a cooling water contact point of an associated marine exhaust system; an exhaust tip; an elastomeric coupling device coupling such exhaust tip to such exhaust pipe portion; a pivot device situated in such exhaust pipe portion; and a flapper pivotally mounted on such pivot device.

In some variations of the foregoing, such exhaust tip may form an opening for exposing a portion of such elastomeric coupling device to such flapper. Further, such flapper may be mounted so as to when pivoting engage such elastomeric coupling device instead of such exhaust pipe portion, in order to reduce noise and wear relative to such flapper. In other alternatives, such exhaust pipe portion and such exhaust tip may comprise metal.

In other present variations, such coupling device may couple such exhaust tip to such exhaust pipe portion with at least some gap therebetween; and such pivot device and such flapper may be mounted proximate such coupling device so that such flapper engages such coupling device instead of either of such exhaust tip or such exhaust pipe portion upon pivoting of such flapper. Further optionally, such flapper may include a flapper tip covered with elastomeric material about the perimeter thereof, and such elastomeric material and such elastomeric coupling device may comprise rubber.

Another present exemplary embodiment relates to a flapper configuration for a marine exhaust system of the type having cooling water in contact with an exhaust pipe, comprising a metallic exhaust pipe portion located upstream relative to a cooling water contact point of an associated marine exhaust system; a metallic exhaust tip; an elastomeric coupling device coupling such exhaust tip to such exhaust pipe portion such as to expose a portion of such elastomeric coupling device to the interior of such exhaust pipe portion; a pivot device situated in such exhaust pipe portion; and a flapper pivotally mounted on such pivot device. Preferably, such flapper when pivoting will engage such elastomeric coupling device instead of such metallic exhaust pipe portion or such metallic exhaust tip, in order to reduce noise and wear relative to such flapper.

In an exemplary optional embodiment of the foregoing, such flapper may include a flapper tip covered with elastomeric material about the perimeter thereof. Still further, such elastomeric material and such elastomeric coupling device may comprise rubber.

It is to be understood by those of ordinary skill in the art that the present subject matter equally encompasses both apparatus and corresponding methodology. One exemplary present method relates to a method for an improved flapper configuration for a marine exhaust system of the type having cooling water in contact with an exhaust pipe, comprising positioning an exhaust pipe portion relatively upstream of a cooling water contact point of an associated marine exhaust system; and positioning a pivot mounted flapper within such exhaust pipe portion such that a portion of the flapper during its normal pivoting movement will contact a sound-deadening surface, for reducing noise and wear relative to such flapper.

Per one present alternative methodology, such exhaust pipe portion may comprise metal and such sound-deadening surface may comprise rubber. In other present alternatives, an exemplary method may further include coupling an exhaust tip to such exhaust pipe portion using an elastomeric coupling device; and wherein positioning such flapper includes mounting such flapper so as to contact such elastomeric coupling device.

In other present variations, such exhaust pipe portion may comprise metal and such elastomeric coupling device comprises rubber, and/or an exemplary method may further include providing elastomeric material at least about a portion of the perimeter of the flapper.

Additional objects and advantages of the present subject matter are set forth in, or will be apparent to, those of ordinary skill in the art from the detailed description herein. Also, it should be further appreciated that modifications and variations to the specifically illustrated, referred and discussed features, elements, and steps hereof may be practiced in various embodiments and uses of the present subject matter without departing from the spirit and scope of the present subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1:
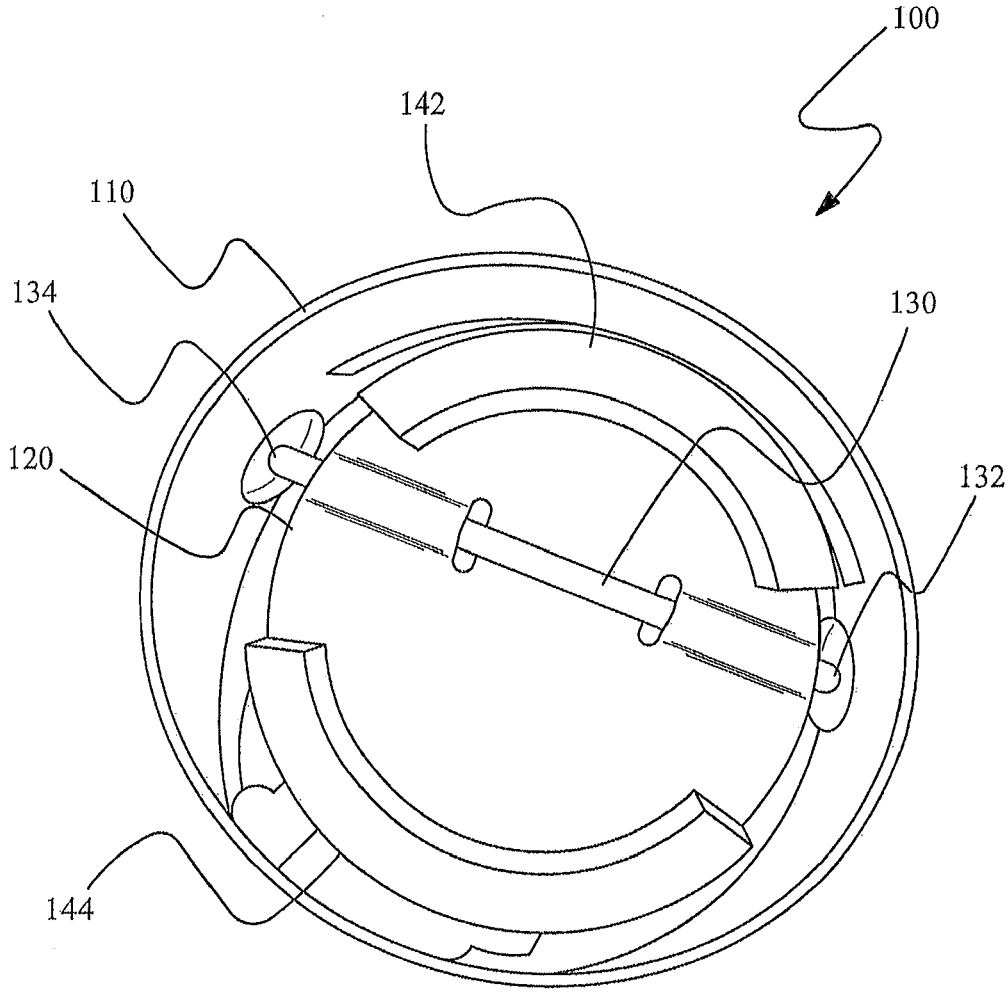
FIG. 1 (Prior Art)
FIG. 1 illustrates an exemplary known exhaust and flapper configuration.

Repeat use of reference characters throughout the present specification and appended drawings is intended to represent same or analogous features, elements, or steps of the present subject matter.

DETAILED DESCRIPTION OF THE PREFERRED EMBODIMENTS

As discussed in the Summary of the Invention section, the present subject matter is particularly concerned with improved flapper configurations for use with marine exhaust systems.

Selected combinations of aspects of the disclosed technology correspond to a plurality of different embodiments of the present subject matter. It should be noted that each of the exemplary embodiments presented and discussed herein should not insinuate limitations of the present subject matter. Features or steps illustrated or described as part of one embodiment may be used in combination with aspects of another embodiment to yield yet further embodiments. Additionally, certain features may be interchanged with similar devices or features not expressly mentioned which perform the same or similar function.

Reference will now be made in detail to the presently preferred embodiments of the subject marine exhaust flapper configurations. First with reference to FIG. 1, an exemplary known marine exhaust flapper configuration will be described.

As shown in FIG. 1, a previously known exemplary flapper configuration 100 is illustrated. Exhaust tip 110 has mounted therein a flapper 120 by way of pivot device 130 mounted within exhaust tip 110 at mounting points 132, 134. Elastomeric material 142, 144 may be applied respectively on opposite diameter portions of flapper 120. Generally, elastomeric material 142, 144 provides some exhaust sealing properties as well as some noise reduction capabilities. Heat normally generated during operation of an associated marine engine, most especially at reduced cooling water flow levels, will, however, tend to deteriorate elastomeric material 142, 144.

Upon deterioration of elastomeric material 142 and 144, direct contact between flapper 120 and internal portions of exhaust pipe 110 may occur. Such direct contact may produce excessive contact noise as well as potential damage to exhaust pipe 110 and flapper 120.

Figure 2:
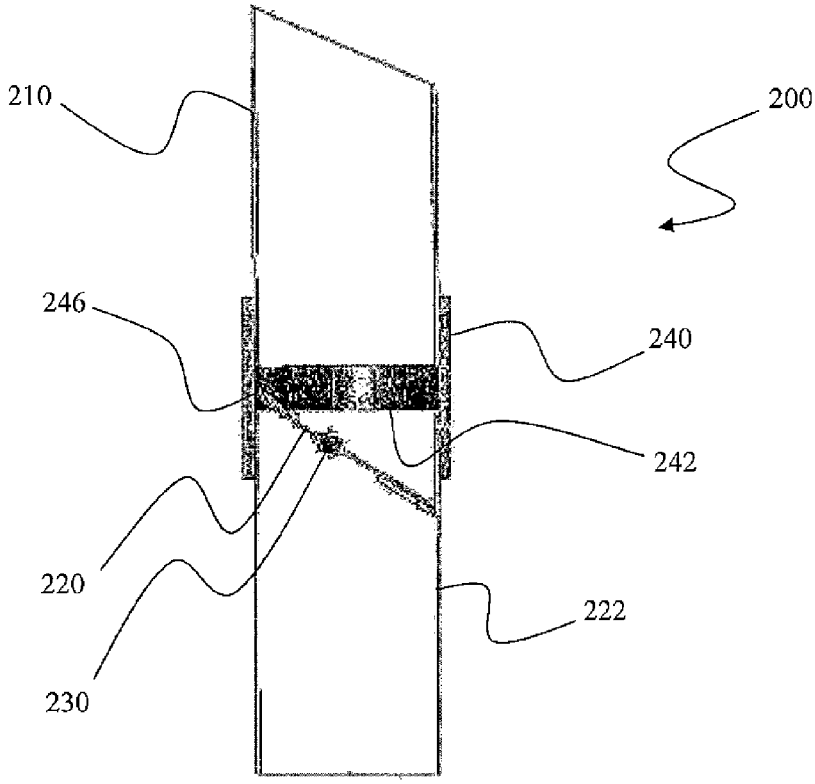
FIG. 2 illustrates a cross-section of an exemplary exhaust tip and coupling component in accordance with the present subject matter.
Figure 3:
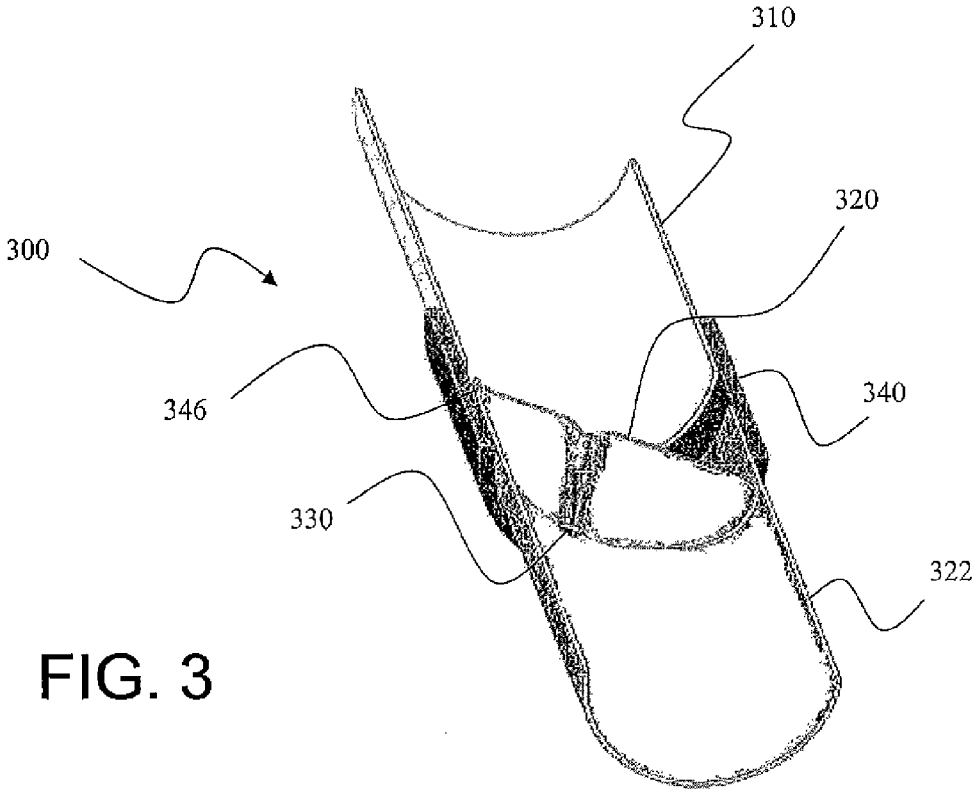
FIG. 3 illustrates an oblique view of a cross-section of an exemplary exhaust tip and flapper arrangement in accordance with present disclosure.

With reference now to FIGS. 2 and 3, a present improved configuration for marine engine exhaust system flappers will be represented and described. As may be seen in FIGS. 2 and 3, flapper 220, 320 has been repositioned from previously known positions, as, for example, as shown at 120 in FIG. 1, to a position upstream of the exhaust system associated with a marine engine (not separately illustrated herewith, and details of which are either well known to those of ordinary skill in the art, or form no part of the present disclosure).

More specifically, exhaust tips 210, 310 may be coupled to a further exhaust pipe portion 222, 322 by way of an elastomeric coupling device 240, 340. Such coupling device 240, 340 may be made of rubber or the like and may be configured as a force fit type device. Alternatively, coupling device 240, 340 may be fitted with a surrounding pipe clamping device or other appropriate securing device, not presently illustrated, to secure the exhaust pipe sections together, as will be well understood by those of ordinary skill in the art from the complete description and disclosure herewith. Flapper 220, 320 may be positioned within exhaust pipe portion 222/322 by way of pivot device 230, 330 such that a tip portion of flapper 220, 320 contacts coupling device 240, 340 at an internally exposed area 246, 346 of coupling device 240, 340.

As illustrated in FIGS. 2 and 3, coupling device 240, 340 is installed in such a manner as to separate exhaust tip 210, 310 at least slightly from an end 242 of exhaust pipe portions 222, 322. In such manner, it is possible to optionally omit or retain such as elastomeric material 142 illustrated in association with flapper 120 of FIG. 1 while optionally retaining material such as corresponding to elastomeric material 144 of FIG. 1.

By coupling exhaust tip 210, 310 to exhaust pipe portion 222, 322 in such a manner, flapper 220, 320 may contact an internal surface portion of elastomeric coupling device 240, 340, thereby avoiding potential direct contact between flapper 220, 320 and any metallic portion of exhaust tip 210, 310.

Those of ordinary skill in the art will appreciate that elastomeric portions similar to portions 142, 144 associated with flapper 110 of FIG. 1 may also be provided in association with flapper 210, 310 of FIGS. 2 and 3. It should further be appreciated that even under the circumstances that such elastomeric portions should deteriorate due to extreme heat levels within the exhaust system, noise levels will remain relatively low due to avoidance of metal-to-metal contact, as otherwise may occur in the known previous configurations.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A flapper configuration for a marine exhaust system of the type having cooling water in contact with an exhaust pipe, comprising:

an exhaust pipe portion located upstream relative to a cooling water contact point of an associated marine exhaust system;

an exhaust tip;

an elastomeric coupling device coupling said exhaust tip to such exhaust pipe portion;

a pivot device situated in said exhaust pipe portion; and a flapper pivotally mounted on said pivot device;

wherein said coupling device couples said exhaust tip to said exhaust pipe portion with at least some gap therebetween; and said pivot device and said flapper are mounted proximate said coupling device so that said flapper engages said coupling device instead of either of said exhaust tip or said exhaust pipe portion upon pivoting of said flapper.

2. A flapper configuration as in claim 1, wherein said exhaust pipe portion and said exhaust tip comprise metal.

3. A flapper configuration as in claim 1, wherein said flapper includes a flapper tip covered with elastomeric material about the perimeter thereof.

4. A flapper configuration as in claim 3, wherein said elastomeric material and said elastomeric coupling device comprise rubber.

5. A flapper configuration for a marine exhaust system of the type having cooling water in contact with an exhaust pipe, comprising:

a metallic exhaust pipe portion located upstream relative to a cooling water contact point of an associated marine exhaust system;

a metallic exhaust tip;

an elastomeric coupling device coupling said exhaust tip to such exhaust pipe portion such as to expose a portion of said elastomeric coupling device to the interior of said exhaust pipe portion;

a pivot device situated in said exhaust pipe portion; and a flapper pivotally mounted on said pivot device, so as to when pivoting engage such elastomeric coupling device instead of said metallic exhaust pipe portion or said metallic exhaust tip, in order to reduce noise and wear relative to such flapper.

6. A flapper configuration as in claim 5, wherein said flapper includes a flapper tip covered with elastomeric material about the perimeter thereof.

7. A flapper configuration as in claim 6, wherein said elastomeric material and said elastomeric coupling device comprise rubber.

8. A method for an improved flapper configuration for a marine exhaust system of the type having cooling water in contact with an exhaust pipe, comprising:

positioning an exhaust pipe portion relatively upstream of a cooling water contact point of an associated marine exhaust system;

positioning a pivot mounted flapper within such exhaust pipe portion such that a portion of the flapper during its normal pivoting movement will contact a sound-deadening surface, for reducing noise and wear relative to such flapper; and coupling an exhaust tip to such exhaust pipe portion using an elastomeric coupling device; and wherein positioning such flapper includes mounting such flapper so as to contact such elastomeric coupling device.

9. A method as in claim 8, wherein such exhaust pipe portion comprises metal and such sound-deadening surface comprises rubber.

10. A method as in claim 8, wherein such exhaust pipe portion comprises metal and such elastomeric coupling device comprises rubber.

11. A method as in claim 8, further including providing elastomeric material at least about a portion of the perimeter of the flapper.

* * * * *